United States Patent [19]

Majeske

[11] 4,023,324

[45] May 17, 1977

[54] METHODS OF MAKING EXPANSION JOINTS FOR ROADS AND BUILDINGS

[76] Inventor: Harry Majeske, c/o Majeske Bros., 6 Roberta Ave., Collingdale, Pa. 19023

[22] Filed: Jan. 8, 1976

[21] Appl. No.: 647,339

[52] U.S. Cl. ..... 52/396; 52/741; 52/397

[51] Int. Cl.[2] ..... E04B 1/62; E04B 1/00

[58] Field of Search ..... 52/396, 397, 398, 98, 52/173; 249/10; 404/66, 67, 69, 48

[56] References Cited

UNITED STATES PATENTS

| | | | |
|---|---|---|---|
| 1,770,167 | 7/1930 | Fischer | 404/66 |
| 2,967,467 | 1/1961 | Maude | 52/396 X |
| 3,813,180 | 5/1974 | O'Brill | 52/396 X |

FOREIGN PATENTS OR APPLICATIONS

| | | | |
|---|---|---|---|
| 678,685 | 1/1964 | Canada | 52/396 |

*Primary Examiner*—Price C. Faw, Jr.
*Assistant Examiner*—Robert C. Farber
*Attorney, Agent, or Firm*—Zachary T. Wobensmith, 2nd; Zachary T. Wobensmith, III

[57] ABSTRACT

The method of making an expansion joint for roads and buildings is described which is particularly suited for structures employing poured concrete slabs or precast concrete panels or slabs, the joint including a stabilized foam strip to both sides of which a slab or panel is assembled the outer or upper face of the strip providing a gaging surface or face, the strip having a readily removable outer portion for application of caulking or sealant material after removal of the outer portion in the space thus provided.

3 Claims, 2 Drawing Figures

METHODS OF MAKING EXPANSION JOINTS FOR ROADS AND BUILDINGS

BACKGROUND OF THE INVENTION

1. Field of the Invention

This invention relates to expansion joints for roads and buildings, and methods of making the same.

2. Brief Description of the Prior Art

It has heretofore been proposed to utilize strip material to provide expansion joints. It has also been proposed to use a removable rigid form which served as a gage for purposes of having the upper surfaces of the finished structure aligned or level and with caulking or sealant material being applied in the space left by the removal of the form. One such form has included a wooden strip which is removed after the poured material has hardened.

Examples of expansion joints are shown in the U.S. Pats. to Rogers; No. 1,890,412, Dockery, No. 1,001,626; Wieberg, No. 1,539,341; and Jeltzel, No. 1,988,900.

SUMMARY OF THE INVENTION

In accordance with the invention an expansion joint for roads and buildings is provided which is particularly suited for but is not limited to structures employing poured concrete slabs or precast concrete panels or slabs, the joint including a stabilized foam strip to both sides of which a slab is poured or assembled, the outer face of the strip providing a gaging surface or face, the strip having an accessible readily removable portion for application of sealant or caulking material after removal of the outer portion in the space thus provided. The strip, in addition to being useful with poured concrete slabs, may also be used in vertical slots between vertically disposed precast concrete slabs or panels.

It is the principal object of the invention to provide a simple but effective expansion joint utilizing an elongated strip of stabilized plastic foam having slits extending inwardly from opposite sides to retain but permit easy removal of a portion of the strip to provide a location for insertion of caulking or sealant material to prevent the entrance of water or moisture.

It is a further object of the invention to provide improved methods of forming an expansion joint in which an elongated stabilized foam strip, rectangular in cross section, is employed, the strip having a readily removable portion the upper face of which serves prior to removal, as a gaging surface.

It is a further object of the invention to provide a caulked expansion joint which employs an inexpensive, light weight, chemically inert, water resistant synthetic plastic closed pore foam strip with a strip-off portion corresponding to the size and shape of the caulked part of the joint.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

Figure 1:
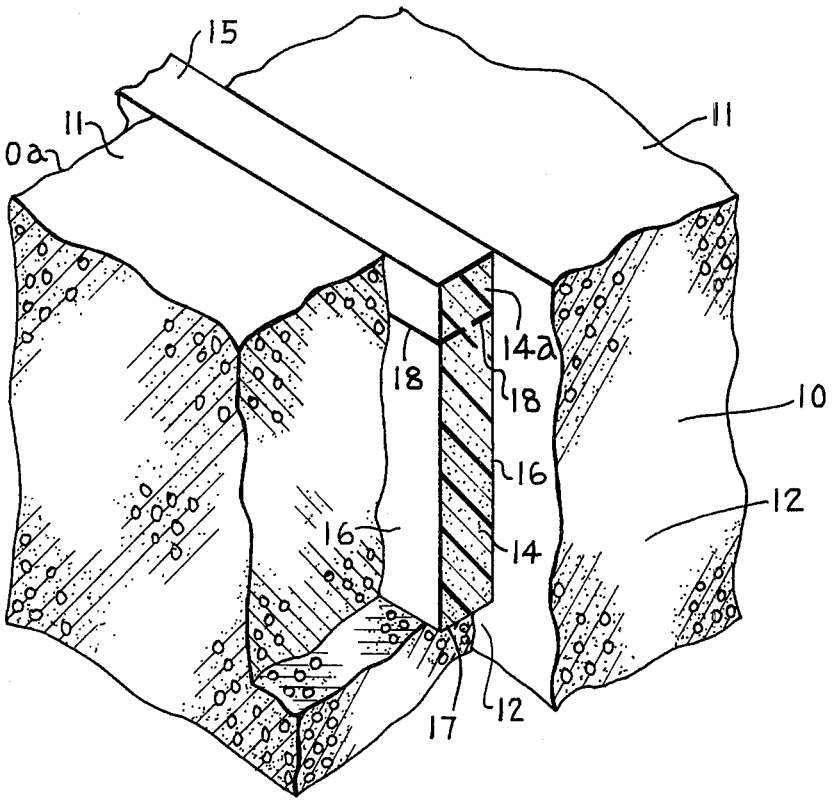
FIG. 1 is a fragmentary sectional view of two spaced slabs or the like at one stage in the making of the joint.
Figure 2:
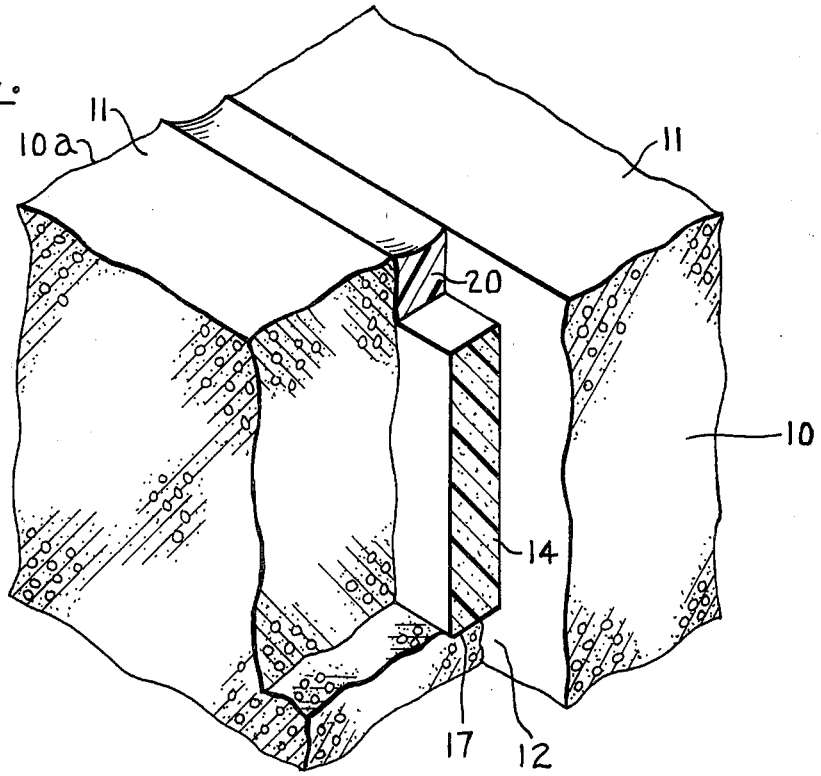
FIG. 2 is a view similar to FIG. 1 but showing the finished expansion joint.

It should, of course, be understood that the description and drawings herein are illustrative merely and that various modifications and changes can be made in the structure disclosed without departing from the spirit of the invention.

Like numerals refer to like parts throughout the several views.

Description of a Preferred Embodiment

Referring now more particularly to the drawings a slab 10 is shown which may be of poured concrete and which has an upper or outer horizontal surface 11 with a vertical end face 12. The end face for the slab 10, considered as a first slab, may be obtained in any desired manner, such as by pouring to a form (not shown).

An elongated strip 14 is provided, preferably rectangular in cross section. The strip 14 is of any desired material but is preferably a closed cell polyethylene foam of a density in the range of 1.6 to 9 pounds per cubic foot, a density of 2 pounds per cubic foot having been found satisfactory in specific embodiments.

Other suitable stabilized closed pore synthetic plastic foams such as those of polyvinyl chloride, neoprene, or where higher heat resistance is desired, of polypropylene. In a specific embodiment, the strip 14 can be one half inch by four inches with a length of many feet, depending upon the specific joint to be made.

The strip 14 illustrated has a top face 15, side faces 16, and a bottom face 17. At a predetermined distance below the top face 15, which in a specific embodiment corresponds to the distance between the side faces 16, slits 18 are cut inwardly from each side face to a depth such that the slits 18 almost meet, but which leave sufficient uncut material to hold the strip 14 together.

In the formation of an expansion joint, after a slab 10 has been formed with its upper surface 11 at the desired elevation, the strip 14 is put in place against the end face 12 and with its top face 15 aligned with or level with the surface 11. The next slab, shown at **10*a* is then poured with its level at that of the top face 15 and the surface 11.**

After the slab **10*a* has hardened sufficiently the upper portion 14*a* of the strip 14, above the slits 18 is removed leaving a recess between the slabs 10 and 10*a* bounded at the bottom by the remaining portion of the strip 14.**

The recess is then filled with a caulking or sealant material 20 of the cold applied type, such as asphalt, to seal the space between the slabs 10 and **10*a*, to prevent entry of water or moisture, and to protect the strip 14** against ultra violet rays from the sun.

Additional slabs similar to the slabs 10 and **10*a* can be added as previously described with expansion joints therebetween, of strips 14 and the caulking material 20.**

The expansion and contraction of the slabs **10, 10*a*, etc., is accommodated by the strip 14 and caulking or sealant material 20.**

The strip 14, of the proper thickness, can also be inserted in vertical slots between precast building wall panels, the strip portion **14*a* removed, and caulking or sealant material 20 applied in the slots in covering relation to the strip 14** and slabs.

I claim:

1. The method of making an expansion joint which comprises selecting a main strip of flexible closed pore plastic foam from the group consisting of stabilized foams of polyethylene, polyvinyl chloride, neoprene and polypropylene, slitting the main strip longitudinally along opposite sides at a location spaced from one edge to a depth insufficient to fully sever said main strip thereby providing a separable strip portion and a remaining strip portion connected to each other by unslitted parts of the main strip, placing said slitted main strip against a panel, forming a panel adjacent to and in contact with said slitted main strip, removing the separable strip portion, and applying sealant material between the panels and in covering relation to the remaining strip portion.

2. The method defined in claim 1 in which said removable portion is at least as high as the width of the strip.

3. The method defined in claim 1 in which the outer surface of the strip portion is aligned with the outer surfaces of adjoining panels.

* * * * *